United States Patent [19]

Shibuya

[11] 4,273,518

[45] Jun. 16, 1981

[54] SWASH-PLATE TYPE COMPRESSOR

[75] Inventor: Tsunenori Shibuya, Konan, Japan

[73] Assignee: Diesel Kiki Co., Ltd., Saitama, Japan

[21] Appl. No.: 68,509

[22] Filed: Aug. 22, 1979

[30] Foreign Application Priority Data

Oct. 16, 1978 [JP] Japan ..... 53-141990[U]

[51] Int. Cl.[3] ..... F04B 1/12

[52] U.S. Cl. ..... 417/269

[58] Field of Search ..... 417/269

[56] References Cited

U.S. PATENT DOCUMENTS

| | | | |
|---|---|---|---|
| 3,215,341 | 11/1965 | Francis | 417/269 |
| 3,552,886 | 1/1971 | Olson, Jr. | 417/269 |
| 3,981,629 | 9/1976 | Nakayama et al. | 417/269 |
| 3,999,893 | 12/1976 | Kishi | 417/269 |
| 4,138,203 | 2/1979 | Slack | 417/269 |

FOREIGN PATENT DOCUMENTS

| | | | |
|---|---|---|---|
| 2166411 | 4/1974 | Fed. Rep. of Germany | 417/269 |

*Primary Examiner*—William L. Freeh

*Attorney, Agent, or Firm*—Frishauf, Holtz, Goodman and Woodward

[57] ABSTRACT

An improved swash-plate type compressor for compressing a refrigerant gas circulating in a refrigerating cycle or a like cycle, in which a passage is provided which communicates a pumping chamber in at least one of the cylinder bores with a radial bearing section journalling the drive shaft, for allowing part of the lubricating oil mixed in the refrigerant gas to be fed to the radial bearing section through said passage.

5 Claims, 5 Drawing Figures

SWASH-PLATE TYPE COMPRESSOR

BACKGROUND OF THE INVENTION

This invention relates to a swash-plate type compressor intended for use in a refrigerating cycle or a like cycle, and more particularly to a swash-plate type compressor which is provided with simple lubricating oil feeding means for feeding steadily lubricating oil mixed in the refrigerant gas to the radial bearing sections for the drive shaft rotatively driving the swash plate.

A conventional compressor of this kind is constructed such that a swash plate is secured on the drive shaft of the compressor and disposed in a swash plate chamber, rotation of which causes pistons engaging the outer fringe of the swash plate to make reciprocal motions with the respective cylinder bores for compression and discharge of the refrigerant gas circulating in the refrigerating circuit. Said drive shaft is inserted in axial through bores continuously formed in two opposed cylinder blocks and radially journalled by plane bearings or needle bearings at radial bearing sections provided within the axial through bores, while simultaneously the drive shaft is axially supported by thrust bearings at opposite sides of the swash plate.

The conventional lubricating oil feeding means for feeding lubricating oil to the above-mentioned bearing sections or like portions include the oil pumping system and the differential pressure system. The oil pumping system is such that an exclusive pump such as gear pump, trochoid pump is provided in one of the cylinder blocks of the compressor, for sucking lubricating oil from an oil reservoir provided in the lower part of the cylinder blocks to forcedly feed it to the bearing sections. However, since an exclusive pump is required as mentioned above, the construction of the compressor is necessarily complicated and accordingly expensive.

The differential pressure system, which dispenses with such exclusive pump, is such that a swash plate is arranged to splash lubricating oil stored in the oil reservoir in the lower part of cylinder blocks into a mist during its rotation caused by the drive shaft, so that the mist is fed to the thrust bearing sections, and thence to the radial bearing sections via gaps between the drive shaft and the axial through bores in the cylinder blocks due to a pressure difference between the swash plate chamber and the radial bearing sections which is caused by the reciprocal motions of the pistons within the cylinder bores communicating with the swash plate chamber. This system has, however, the disadvantage that just after the start of the compressor such pressure difference caused by the reciprocal motions of the pistons is not so sufficient that an adequate amount of lubricating oil is not fed to the radial bearing sections, resulting in accidents such as seizure of said bearing sections.

BRIEF SUMMARY OF THE INVENTION

It is therefore an object of the invention to provide a swash-plate type compressor which is provided with lubricating oil feeding means which is capable of steadily feeding lubricating oil to the radial bearing sections even just after the start of the compressor, thereby to eliminate the possibility of seizure of said sections which would occur due to deficiency of the lubricating oil.

It is a further object of the invention to provide a swash-plate type compressor which is provided with lubricating oil feeding means which is simple in construction and is immediately mountable in an existing type swash-plate compressor.

These and other objects, features and advantages of the invention will be more apparent from the ensuing detailed description and the accompanying drawings.

DETAILED DESCRIPTION

Figure 1:
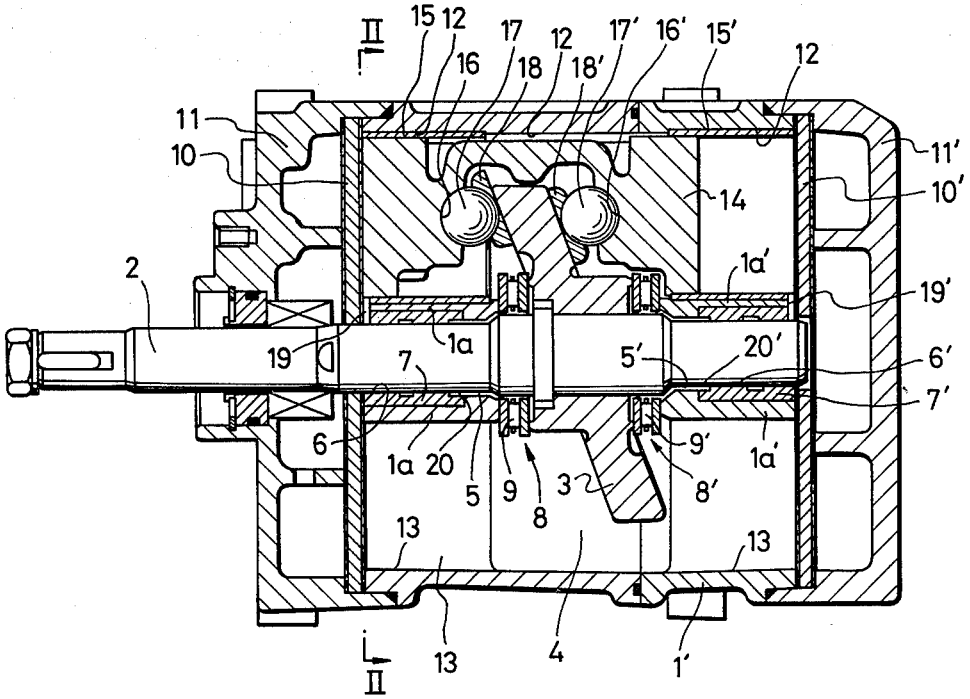
FIG. 1 is an axial sectional view of a swash-plate type compressor according to an embodiment of the invention.
Figure 2:
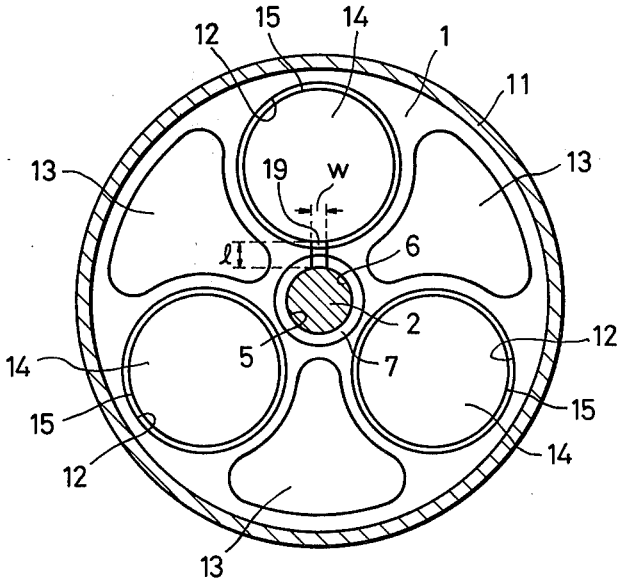
FIG. 2 is a sectional view taken along line II—II of FIG. 1.

In FIGS. 1 and 2, a pair of cylinder blocks 1, 1' are combined together in an axial alignment. A drive shaft 2 axially penetrates these combined cylinder blocks 1, 1', on which a swash plate 3 is secured. The swash plate 3 is disposed within a swash plate chamber 4 formed between the cylinder blocks 1, 1'.

The drive shaft 2 is inserted in axial through bores 5, 5' continuously formed centrally of the cylinder blocks 1, 1', for rotation relative to the cylinder blocks 1, 1' in a fashion radially journalled on plane bearings 7, 7' at radial bearing sections 6, 6' provided at opposite ends of the axial through bores 5, 5', while simultaneously axially supported by needle bearings 9, 9' at thrust bearing sections 8, 8' provided at opposite sides of the swash plate 3. The radial bearing sections 6, 6' communicate with the thrust bearing sections 8, 8' via gaps 20, 20' between the drive shaft 2 and the through bores 5, 5', respectively.

A front cylinder head 11 and a rear cylinder head 11' are secured to the outer ends of the cylinder blocks 1, 1' with valve plates 10, 10' intervening therebetween, respectively. These cylinder blocks 1, 1', have three cylinder bores 12 axially extending therethrough and surrounding the axial through bores 5, 5' at circumferentially equal intervals. Further formed in the cylinder blocks 1, 1' are three chambers 13, each having a sectorial cross section, axially extending between adjacent cylinder bores 12, at circumferentially equal intervals. The upper two of these chambers 13 are used as passages for refrigerant gas being delivered or sucked, and the lower one, which communicates with said swash plate chamber 4, is used as an oil reservoir.

A double acting piston 14 is slidably inserted in each of the cylinder bores 12 for defining pumping chambers therein in cooperation with the cylinder bore and the valve plates 10, 10'. A liner 15 internally lines each cylinder bore 12. The piston 14 has its central part formed concave in which the outer fringe of the swash plate 3 is slidably held via bearing balls 17, 17' received in pockets 16, 16' and shoes 18, 18'.

With this arrangement, when the drive shaft 2 is rotated to cause rotation of the swash plate 3, the three pistons 14 make reciprocal motions within the respective cylinder bores 12, with a phase difference of 120° with respect to each other, to carry out pumping actions in cooperation with suction and discharge valves (not shown) provided on the valve plates 10, 10'. The swash plate 3 being rotated splashes lubricating oil stored on the bottom of the swash plate chamber 4, into a mist which is fed to the thrust bearing sections 8, 8', bearing balls 17, 17' and pistons 14, etc. for lubrication thereof.

At each of the opposite outer ends of the cylinder blocks 1, 1' facing the valve plates 10, 10', the plane bearing 7 (7'), the central portion 1a (1a') of the cylinder block 1 (1') and the liners 15 have respective outer end faces substantially flush with each other, over which end faces are formed a series of continuous grooves 19 (19') which cooperate with the associated valve plate 10 (10') to provide a lubricating oil passage communicating the associated radial bearing section 6 (6') with the upper one of the cylinder bores 12. Although only grooves 19, 19' communicating with the upper cylinder bore 12 are provided in the illustrated embodiment, further similar grooves may of course be formed in said outer end faces, which communicate the radial bearing sections with the other cylinder bores 12.

Figure 3:
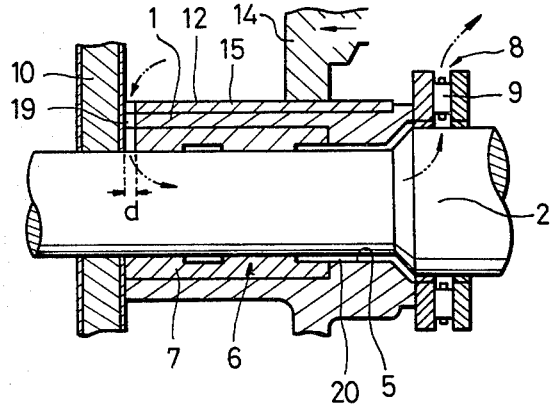
FIG. 3 is an enlarged sectional view of the bearing sections of the compressor of FIG. 1 showing the flow of lubricating oil during the discharge stroke.
Figure 4:
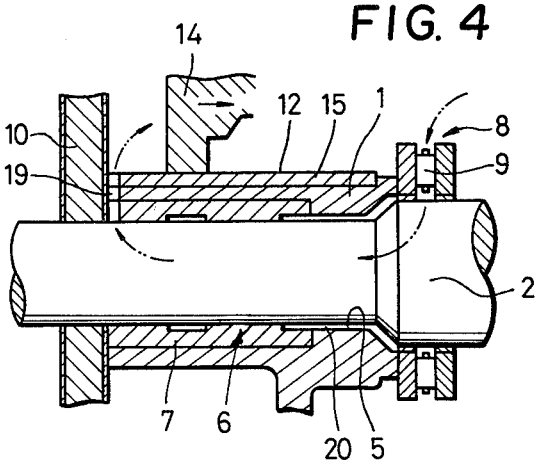
FIG. 4 is a view similar to FIG. 3, showing the flow of lubricating oil during the suction stroke.

FIGS. 3 and 4 illustrate how lubricating oil is fed to the radial bearing sections 6 provided in the compressor according to the invention. When the associated piston 14 leftwardly slides in the cylinder bore 12 to execute its discharge stroke in response to rotation of the swash plate 3, the refrigerant gas introduced into a pumping chamber defined by the left-hand valve plate 10, the cylinder bore 12 and the left end of the piston 14 is compressed. Accordingly, the lubricating oil mixed in the refrigerant gas becomes condensed, part of which is guided through the continuous grooves 19 into the radial bearing section 6 to lubricate the same, and thence returned to the swash plate chamber 4 via the gap 20 between the drive shaft 2 and the axial through bore 5, as shown in dot-dash line in FIG. 3.

When the piston 14 slides rightwardly into the suction stroke, the pumping chamber has a negative pressure which is lower than the pressure prevailing in the swash plate chamber 4, so that said negative pressure is introduced into the swash plate chamber 4 via the grooves 19 and the gap 20 between the drive shaft 2 and the axial through bore 5. As a consequence, part of the oily mist formed in the swash plate chamber 4 by the rotating swash plate 3 is guided to the radial bearing section 6 via the gap 20 between the drive shaft 2 and the axial through bore 5, as well as to the thrust bearing section 8, as shown in dot-dash line in FIG. 4. After lubricating the bearing section 6, the oily mist is returned into said pumping chamber via the grooves 19.

Thus, lubricating oil is constantly forcedly fed to the radial bearing section 6 during both the suction stroke and the delivery stroke due to the positive pressure and the negative pressure repeatedly alternately produced in the pumping chamber in the cylinder bore by the reciprocating motion of the piston, so that an accident such as seizure of the bearing section can be avoided. Particularly, even when there is not yet produced a sufficient amount of oily mist in the swash plate chamber 4 just after the start of the compressor, part of the oil mixed in the refrigerant gas in the cylinder bore is supplied to the radial bearing section 6 via the grooves 19, thus permitting the compressor to operate without fail.

Figure 5:
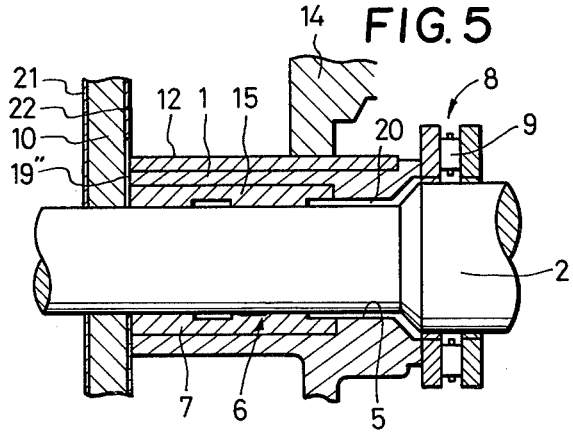
FIG. 5 is an enlarged sectional view of the bearing sections of a swash-plate compressor according to another embodiment of the invention.

In FIG. 5 is illustrated another embodiment of the invention in which a groove similar to grooves 19 is formed at a location different from that in the preceding embodiment, i.e., on the side of the valve plate.

More specifically, a discharge valve 21 and a suction valve 22 are applied, respectively, to the outer and inner walls of the valve plate 10, as conventionally employed in the art. A groove 19'' is formed in said inner sheet-like suction valve 22 facing the cylinder block 1, by cutting off part of the suction valve 22. The groove 19'' cooperates with the end faces of the plane bearing 7, cylinder block 1 and liner 15 to form a lubricating oil passage communicating the cylinder bore 12 with the radial bearing section 6. Similarly to the preceding embodiment, lubrication of the radial bearing section 6 is effected in such a manner that part of the oil contained in the refrigerant gas in the cylinder bore is guided to said section 6 through said passage formed by the groove 19'', while said passage acts as a passage for introduction of the negative pressure in the pumping chamber into the swash plate chamber 4 to cause part of the oily mist in the chamber 4 to be fed to the radial bearing section 6.

Though not shown, a similar groove to the groove 19'' is also provided on the side of the rear valve plate 10'.

The sizes of the above-mentioned grooves 19, 19', 19'' are determined at suitable values such that a necessary amount of oil is supplied to the radial bearing section insofar as the suction and delivery action of the piston within the cylinder bore is carried out without difficulties. For instance, in the case of a compressor for use in a car cooler, the continuous grooves 19 (19') shown in FIGS. 1 through 4 have in total a width w of 0.5–1 mm, a depth d of 0.3–0.5 mm and a length of l of 4–8 mm.

Although a plane bearing is used in the radial bearing section in the above-described embodiments, the plane bearing is not limitative in the invention, but other types of bearings such as needle bearing may of course be used.

As mentioned above, by providing an oil passage communicating the pumping chamber in at least one of the cylinder bores with the associated radial bearing section, oil feeding to the radial bearing section is effected reciprocally from the pumping chamber and from the swash plate chamber in response to changes in the pressure of the pumping chamber even immediately after the start of the compressor, thereby to prevent seizure of said bearing section.

Further, since the groove can be formed on only one of the cylinder block side and the valve plate side, the compressor is simple in construction and inexpensive and the oil feeding means of the invention can immediately be employed in an existing type of swash-plate compressor.

While preferred embodiments of the invention have been described, variations thereto will occur to those skilled in the art within the scope of the present inventive concepts which are delineated by the following claims.

What is claimed is:

1. In a swash-plate type compressor having a pair of cylinder blocks combined together in axial alignment, each including an axial through bore formed centrally thereof, said cylinder blocks defining a swash plate chamber therebetween; a drive shaft rotatably inserted in said axial through bores; a pair of radial bearing sections provided between said axial through bores and said drive shaft, each receiving a radial bearing radially supporting said drive shaft; a swash plate secured on said drive shaft within said swash plate chamber; and a pair of valve plates arranged on opposite ends of said combined cylinder blocks; said combined cylinder blocks including a plurality of cylinder bores axially extending therethrough, each of which receives a piston for sliding therein and cooperates with the valve plates and the piston to form pumping chambers therebetween; and said swash plate has an outer fringe thereof disposed in engagement with the pistons and is rotatable in unison with the drive shaft being rotated to cause reciprocal motion of the pistons within the resective cylinder bores to carry out pumping action;

the improvement comprising:

a gap provided between said drive shaft and each of said through bores; and passage means directly communicating each of said pumping chambers formed in at least one of the cylinder bores with said gap provided between said drive shaft and each of said through bores;

said gap communicating said passage means with said swash plate chamber through an associated one of said radial bearings, whereby part of oil contained in refrigerant gas in said associated pumping chamber is supplied to said associated radial bearing section via said passage means and said gap due to a pressure difference between said swash plate chamber and said associated pumping chamber caused by the reciprocating movement of said piston within said at least one of the cylinder bores.

2. An improved swash-plate type compressor as recited in claim 1, further comprising a sheet-like suction valve arranged on an inner face of each valve plate, and wherein said passage means comprises a groove formed in an inner face of each suction valve facing the central end face of an associated one of the cylinder blocks for directly communicating an associated one of the pumping chambers with an associated one of the axial through bores.

3. An improved swash-plate type compressor as recited in claim 1, wherein said passage means comprises a groove formed in a central outer end face of each cylinder block facing an associated one of the valve plates for directly communicating said pumping chamber with said gap.

4. An improved swash-plate type compressor as recited in claim 3, wherein said radial bearing sections each have an outer end face thereof disposed substantially flush with said central outer end face of an associated one of the cylinder blocks and includes a groove formed in said outer end face thereof and continuous from said groove formed in said central outer end of said cylinder block.

5. An improved swash-plate type compressor as recited in claim 3, further comprising a liner internally lining each cylinder bore and having a groove formed in an outer end face thereof facing the associated valve plate and continuous from said groove in the central outer end face of the associated cylinder block.

* * * * *